US010894193B2

(12) United States Patent
Chen et al.

(10) Patent No.: US 10,894,193 B2
(45) Date of Patent: Jan. 19, 2021

(54) GOLF CLUB HEADS WITH CAVITIES AND RELATED METHODS

(71) Applicant: KARSTEN MANUFACTURING CORPORATION, Phoenix, AZ (US)

(72) Inventors: Xiaojian Chen, Phoenix, AZ (US); Cory S. Bacon, Cave Creek, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 0 days.

(21) Appl. No.: 15/868,078

(22) Filed: Jan. 11, 2018

(65) Prior Publication Data

US 2018/0133568 A1 May 17, 2018

Related U.S. Application Data

(63) Continuation-in-part of application No. 14/555,025, filed on Nov. 26, 2014, now abandoned.

(51) Int. Cl.
*A63B 53/04* (2015.01)
*A63B 60/02* (2015.01)

(52) U.S. Cl.
CPC ..... *A63B 53/0475* (2013.01); *A63B 53/0408* (2020.08); *A63B 53/0433* (2020.08); *A63B 60/02* (2015.10); *A63B 2053/0491* (2013.01); *A63B 2209/00* (2013.01)

(58) Field of Classification Search
CPC ..... A63B 3/0475; A63B 53/0433; A63B 53/0408; A63B 2209/00; A63B 2053/0491; A63B 60/02
See application file for complete search history.

(56) References Cited

U.S. PATENT DOCUMENTS

| | | | | |
|---|---|---|---|---|
| 2,846,228 | A | 8/1958 | Reach | |
| 3,961,796 | A * | 6/1976 | Thompson | A63B 53/04 473/328 |
| 3,979,122 | A * | 9/1976 | Belmont | A63B 53/047 473/336 |
| D244,558 | S | 5/1977 | Elkins, Jr. | |
| 4,145,052 | A * | 3/1979 | Janssen | A63B 53/04 473/338 |
| 4,355,808 | A | 10/1982 | Jernigan et al. | |
| 4,523,759 | A | 6/1985 | Igarashi | |
| 4,645,207 | A | 2/1987 | Teramoto et al. | |
| 4,836,550 | A | 6/1989 | Kobayashi | |
| 5,207,427 | A | 5/1993 | Saeki | |
| 5,255,918 | A | 10/1993 | Anderson et al. | |
| 5,290,036 | A | 3/1994 | Fenton et al. | |
| 5,346,219 | A | 9/1994 | Pehoski et al. | |
| 5,492,327 | A | 2/1996 | Biafore, Jr. | |
| 5,586,947 | A | 12/1996 | Hutin | |
| 5,588,923 | A | 12/1996 | Schmidt et al. | |

(Continued)

*Primary Examiner* — William M Pierce

(57) ABSTRACT

Embodiments of golf club heads with cavities and methods to manufacture golf club heads with cavities are generally described herein. In some embodiments, a golf club head comprises a body. The body comprises a strikeface, a backside of the strikeface, a heel region, a toe region opposite the heel region, a sole, a first cavity at the backside of the strikeface, a rear portion opposite the strikeface, and a second cavity at the rear portion. In many embodiments, the golf club head further comprises a cap closing off the second cavity. Other embodiments may be described and claimed.

16 Claims, 13 Drawing Sheets

(56) References Cited

U.S. PATENT DOCUMENTS 5,779,560 A 7/1998 Buck et al.
5,967,903 A 10/1999 Cheng
6,080,069 A * 6/2000 Long ..... A63B 53/04 473/332
6,086,485 A 7/2000 Hamada et al.
6,193,614 B1 * 2/2001 Sasamoto ..... A63B 53/04 473/329
6,196,936 B1 3/2001 Meckel
6,368,231 B1 4/2002 Chen
6,379,263 B2 4/2002 Erickson et al.
6,419,593 B1 7/2002 Heinrich et al.
6,454,665 B2 9/2002 Antonious
6,719,641 B2 4/2004 Dabbs et al.
6,729,972 B2 5/2004 Boord
6,811,496 B2 11/2004 Wahl et al.
7,077,763 B2 7/2006 Wahl et al.
7,169,057 B2 1/2007 Wood et al.
7,186,188 B2 3/2007 Gilbert et al.
7,192,362 B2 3/2007 Gilbert et al.
D596,257 S 7/2009 Jertson et al.
7,621,822 B2 11/2009 Roach
7,670,232 B2 3/2010 Franklin et al.
7,744,485 B2 6/2010 Jones et al.
7,803,062 B2 9/2010 Gilbert et al.
8,182,364 B2 * 5/2012 Cole ..... A63B 53/047 473/335
8,221,261 B2 7/2012 Curtis et al.
8,235,841 B2 8/2012 Stites et al.
8,366,566 B1 2/2013 Rollinson
8,403,771 B1 3/2013 Rice et al.
8,430,763 B2 4/2013 Beach et al.
8,480,514 B2 7/2013 Hartwell et al.
8,506,415 B2 8/2013 Franklin
8,517,859 B2 8/2013 Golden et al.
8,535,176 B2 9/2013 Bazzel et al.
8,740,721 B2 6/2014 Yamamoto
8,900,069 B2 12/2014 Beach
8,911,301 B1 12/2014 Allen
8,911,302 B1 12/2014 Ivanova
8,986,133 B2 3/2015 Bennett et al.
9,033,818 B2 5/2015 Myrhum et al.
9,950,219 B2 * 4/2018 Larson ..... A63B 53/0466
2001/0055996 A1 12/2001 Iwata et al.
2002/0042307 A1 4/2002 Deshmukh
2002/0183134 A1 12/2002 Allen et al.
2003/0157995 A1 8/2003 Mahaffey
2004/0043830 A1 3/2004 Imamoto
2004/0142764 A1 7/2004 Sano
2005/0020376 A1 1/2005 Huang
2005/0143188 A1 1/2005 Tseng
2005/0181888 A1 8/2005 Hou et al.
2005/0282655 A1 12/2005 Sasaki
2006/0199661 A1 9/2006 Deng et al.
2006/0211514 A1 9/2006 Deshmukh
2006/0217216 A1 9/2006 Iizuka
2006/0234804 A1 10/2006 Gilbert et al.
2006/0234808 A1 10/2006 Gilbert et al.
2006/0234811 A1 10/2006 Gilbert et al.
2007/0049403 A1 3/2007 Chen
2007/0072698 A1 3/2007 Juang
2007/0078028 A1 4/2007 Huang
2007/0149316 A1 6/2007 Nishino
2007/0155534 A1 7/2007 Tsai et al.
2007/0281796 A1 * 12/2007 Gilbert ..... A63B 53/0475 473/332
2008/0076597 A1 3/2008 Roach et al.
2008/0096687 A1 4/2008 Chen
2008/0318708 A1 12/2008 Clausen et al.
2009/0170629 A1 7/2009 Hilton
2010/0087269 A1 4/2010 Snyder et al.
2010/0093459 A1 4/2010 Cole et al.
2011/0003649 A1 1/2011 Liu
2011/0009211 A1 1/2011 Chao et al.
2011/0201444 A1 * 8/2011 Stokke ..... A63B 53/047 473/291
2012/0264537 A1 * 10/2012 Breier ..... A63B 53/04 473/331
2013/0053169 A1 2/2013 Dumas et al.
2013/0210543 A1 8/2013 Radcliffe et al.
2013/0281227 A1 10/2013 Roach
2013/0324301 A1 * 12/2013 Boyd ..... A63B 53/0466 473/342
2013/0331201 A1 12/2013 Wahl et al.
2013/0344989 A1 * 12/2013 Hebreo ..... A63B 60/02 473/349
2014/0274454 A1 9/2014 Snyder
2015/0328506 A1 11/2015 Morales et al.

* cited by examiner

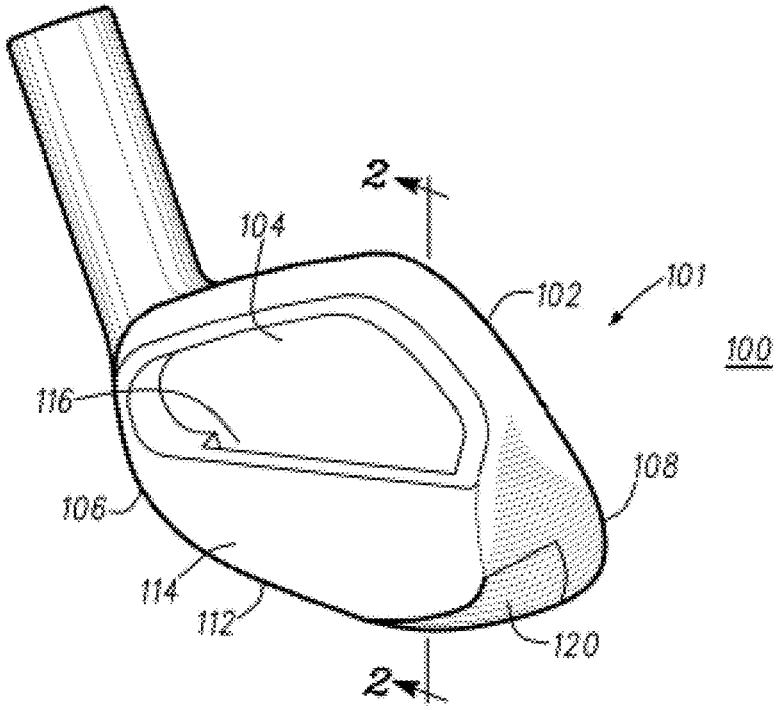
FIG.1
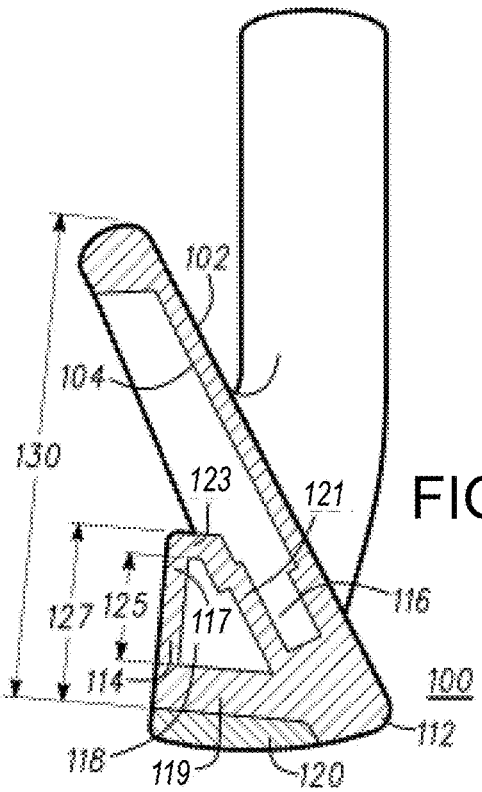
FIG.2
FIG.3
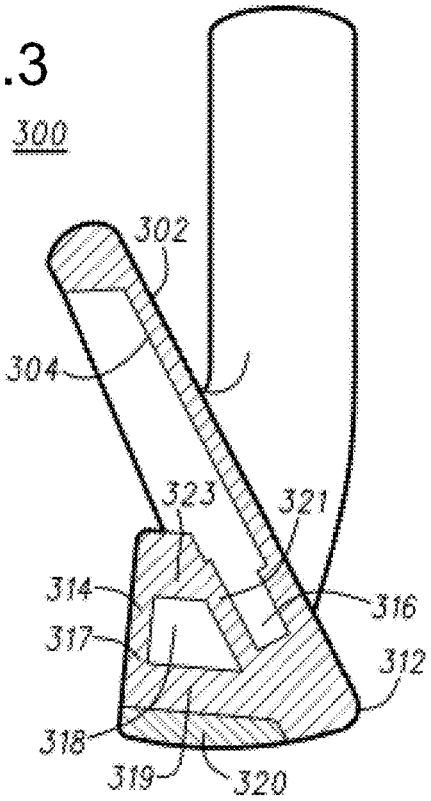

GOLF CLUB HEADS WITH CAVITIES AND RELATED METHODS

CROSS REFERENCE TO RELATED APPLICATION

This is a continuation in part of U.S. Non-Provisional application Ser. No. 14/555,025, filed on Nov. 26, 2014, the contents of which are incorporated fully by reference herein.

TECHNICAL FIELD

This disclosure relates generally to golf clubs, and relates more particularly to golf club heads with cavities.

BACKGROUND

Golf club manufacturers have designed golf club heads to accommodate the preferences of an individual user as well as the individual user's golfing ability. Some golf club manufactures have designed golf club heads to accommodate the preferences of an individual user, such as an individual user's preference on the golf club head's look and feel. Some individual users may prefer a heavy look, such as a muscleback iron. Golf club manufacturers have designed golf club heads to accommodate the preferences of an individual user while designing golf club heads with enhanced weight distribution and/or a lower center of gravity.

BRIEF DESCRIPTION OF THE DRAWINGS

To facilitate further description of the embodiments, the following drawings are provided in which:

FIG. 1 depicts back, toe-side perspective view of a golf club head according to an embodiment;

FIG. 2 depicts the golf club head of FIG. 1 along the cross-sectional line 2-2 in FIG. 1;

FIG. 3 depicts a golf club head similar to the golf club head of FIG. 1 along the cross-sectional line 2-2 in FIG. 1, according to another embodiment;

Figure 4:
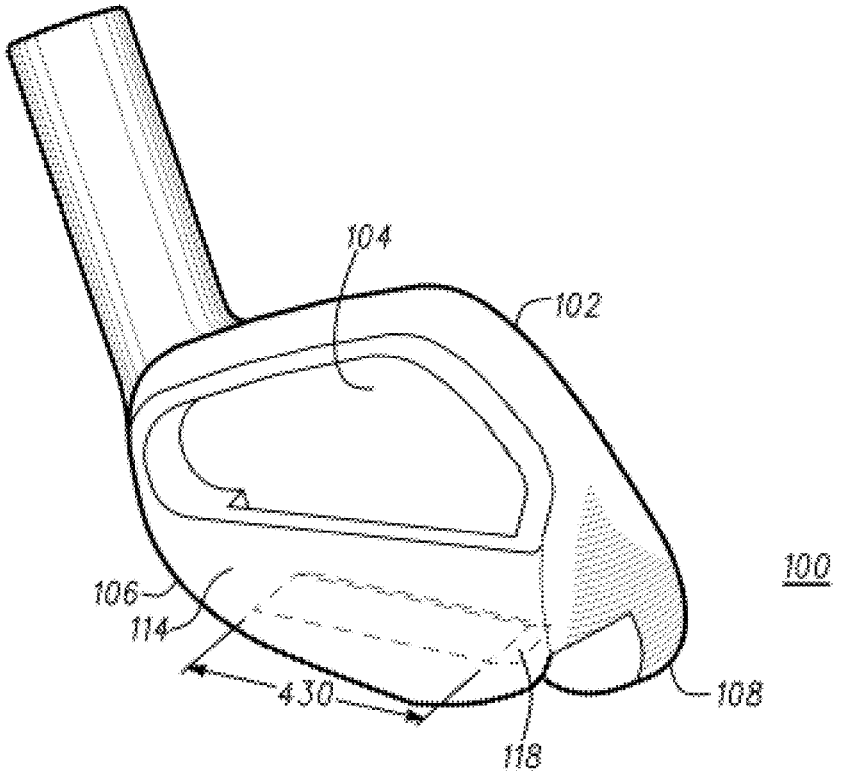
FIG. 4 depicts a back, toe-side perspective, x-ray view of the golf club head of FIG. 1.

For simplicity and clarity of illustration, the drawing figures illustrate the general manner of construction, and descriptions and details of well-known features and techniques may be omitted to avoid unnecessarily obscuring the golf clubs and their methods of manufacture. Additionally, elements in the drawing figures are not necessarily drawn to scale. For example, the dimensions of some of the elements in the figures may be exaggerated relative to other elements to help improve understanding of embodiments of the golf club heads with cavities and related methods. The same reference numerals in different figures denote the same elements.

The terms "first," "second," "third," "fourth," and the like in the description and in the claims, if any, are used for distinguishing between similar elements and not necessarily for describing a particular sequential or chronological order. It is to be understood that the terms so used are interchangeable under appropriate circumstances such that the embodiments of golf club heads with cavities and related methods herein are, for example, capable of operation in sequences other than those illustrated or otherwise described herein. Furthermore, the terms "contain," "include," and "have," and any variations thereof, are intended to cover a non-exclusive inclusion, such that a process, method, article, or apparatus that comprises a list of elements is not necessarily limited to those elements, but may include other elements not expressly listed or inherent to such process, method, article, or apparatus.

The terms "left," "right," "front," "back," "top," "bottom," "side," "under," "over," and the like in the description and in the claims, if any, are used for descriptive purposes and not necessarily for describing permanent relative positions. It is to be understood that the terms so used are interchangeable under appropriate circumstances such that the embodiments of golf clubs and methods of manufacture described herein are, for example, capable of operation in other orientations than those illustrated or otherwise described herein.

The terms "couple," "coupled," "couples," "coupling" and the like as used herein, is defined as directly or indirectly connected in a physical, mechanical, or other manner. Two or more mechanical elements may be mechanically coupled together, but not electrically or otherwise coupled together. Coupling many be for any length of time, e.g., permanent or only for an instant.

"Mechanical coupling" and the like should be broadly understood and include mechanical coupling of all types.

The absence of the word "removably," "removable," and the like near the word "coupled," and the like does not mean that the coupling, etc. in question is or is not removable.

DESCRIPTION OF EXAMPLES OF EMBODIMENTS

Various embodiments include a golf club head comprising a body. The body comprises a strikeface, a backside of the strikeface, a heel region, a toe region opposite the heel region, a sole, and a rear portion opposite the strikeface. In many embodiments, the body further comprises a first cavity at the backside of the strikeface and a second cavity at the rear portion. In some embodiments, the golf club head also comprises a cap closing off the second cavity.

Some embodiments include a golf club comprising a shaft, a grip and a golf club head. The golf club head comprises a body. The body comprises a strikeface, a backside of the strikeface, a heel region, a toe region opposite the heel region, a sole, and a rear portion opposite the strikeface. In many embodiments, the body further comprises a first cavity at the backside of the strikeface and a second cavity at the rear portion. In some embodiments, the golf club head also comprises a cap closing off the second cavity.

Other embodiments include a method for manufacturing a golf club head. In many embodiments the method comprises forming a body from a first material having a first density. The body having a strikeface, a backside of the strikeface, a heel region, a toe region opposite the heel region, a sole, a first cavity at the backside of the strikeface, and a rear portion opposite the strikeface. In some embodiments, the method can also comprise forming a second cavity at the rear portion and affixing a cap at the second cavity to close off the second cavity.

Turning to the drawings, FIG. 1 illustrates a back, toe-side perspective view of a golf club head 100 according to an embodiment. Golf club head 100 is merely exemplary and is not limited to the embodiments presented herein. Golf club head 100 can be employed in many different embodiments or examples not specifically depicted or described herein.

In some embodiments, golf club head 100 can be an iron-type golf club head. In other embodiments, golf club head 100 can be another type of golf club head (e.g., a driver-type club head, a fairway wood-type club head, a hybrid-type club head, a wood-type club head, a wedge-type club head, or a putter-type club head.) In some embodiments, golf club head 100 comprises a body 101. In many embodiments, body 101 comprises a strikeface 102, a backside 104 of strikeface 102, a heel region 106, a toe region 108 opposite heel region 106, and a sole 112 at the bottom of body 101.

The golf club heads 100, 300, 700, 900, and 1000 can be viewed from various perspectives, while in address position, including but not limited to: a front view, a rear view, a toe-side view, a heel-side view, a top view, a sole view, and various perspective views. The front view of the golf club head 100, 300, 700, 900, or 1000 views the club head from a direction forward of the strikeface 102, 302, 702, 902, or 1102, parallel to the ground plane, and orthogonal to the strikeface 102, 302, 702, 902, or 1102. The rear view of the golf club head 100, 300, 700, 900, or 1000 views the club head from a direction rearward of the backside 104, 304, 704, 904, or 1104, parallel to the ground plane 10, 910, or 1010, and orthogonal to the strikeface 102 302, 702, 902, or 1102. The toe-side view of the golf club head 100, 300, 700, 900, or 1000 views the club head from a toe-to-heel direction that is parallel to the strikeface 102, 302, 702, 902, or 1102 and parallel to the ground plane 10, 910, or 1010. The heel-side view of the golf club head 100, 300, 700, 900, or 1000 views the club head from a heel-to-toe direction that is parallel to the strikeface 102, 302, 702, 902, or 1102 and parallel to the ground plane 10, 910, or 1010. The sole view of the golf club head 100, 300, 700, 900, or 1000 views the club head from a sole-to-top direction orthogonal to the ground plane 10, 910, or 1010. The top view of the golf club head 100, 300, 700, 900, or 1000 views the club head from a top-to-sole direction orthogonal to the ground plane 10, 910, or 1010.

When the golf club head is at address position and is viewed from the rear view, the sole 112 is not visible. The sole 112 ends where the body of the golf club head curves upward to form the toe region 108. Body 101 can further comprise a first cavity 116 at backside 104. Further, body 101 can comprise a rear portion 114 opposite strikeface 102. First cavity 116 can be between backside 104 and rear portion 114. In some embodiments, golf club head 100 can comprise a hosel, which in other embodiments can be omitted. In many embodiments, rear portion 114 can be designed to look similar to a traditional muscleback iron golf club head. For example, many muscleback irons have a full back or full rear portion of a golf club head. Muscleback irons differ from non-muscleback irons in which the rear or back of the golf club head has been hollowed out to at least partially remove the muscleback, full back and/or rear portion. In some embodiments, rear portion 114 can be designed to provide a heavy or thick look to the golf club head.

Some users may prefer a heavy look to a golf club head, such as a muscleback golf club head. However, in many instances, a muscleback golf club head may not provide an enhanced weight distribution and/or a lower center of gravity. For instance, muscleback irons with wide soles can add weight high and in the middle of the golf club head. Also, many muscleback golf clubs may have a greater loss of distance compared to non-muscleback golf clubs. Additionally, many muscleback golf clubs have a lower moment of inertia, or forgiveness, than a non-muscleback golf club. For users who prefer the heavy look to a golf club head, but would like an enhanced weight distribution, higher moment of inertia and/or a lower center of gravity, a second cavity within the rear portion or muscleback portion of the golf club head can be designed.

In some embodiments, the higher moment of inertia (hereafter "MOI") can be at least partially due to perimeter weighting. In other embodiments, the higher moment of inertia can be at least partially due to a second cavity in body 101. For example, in many embodiments, such as the one illustrated in FIGS. 1 and 2, body 101 further comprises a second cavity 118 (FIG. 2) at or within rear portion 114. In some embodiments, second cavity 118 can be designed to enhance weight distribution of golf club head 100, while maintaining a heavy or muscleback look of rear portion 114. In some embodiments, second cavity 118 can be hollow, thereby reducing the mass and/or weight of rear portion 114. In other embodiments, second cavity 118 can be at least partially hollow. In other embodiments, second cavity 118 can comprise a filler material in all or a portion of second cavity 118. In embodiments wherein second cavity 118 comprises the filler material, the filler material can be less dense than the material(s) used for other parts of body 101 (i.e., the club head density).

In some embodiments, such as the one illustrated in FIGS. 1 and 2, second cavity 118 can comprise an opening at least partially at toe region 108. In some embodiments, second cavity 118 can comprise an opening at least partially at sole 112. In some embodiments, second cavity 118 can comprise an opening at least partially at heel region 106. In many embodiments, second cavity 118 comprises an opening at least partially at toe region 108 and at least partially at sole 112 and does not comprise an opening at heel region 106. In some embodiments, second cavity 118 can be open to first cavity 116 to form one larger cavity. In some embodiments, wherein second cavity 118 is open to first cavity 116, the one larger cavity can comprise at least two distinct regions. In other embodiments, wherein second cavity 118 is open to first cavity 116, the one larger cavity can comprise a single region.

In some embodiments, such as the embodiment of FIGS. 1 and 2, the second cavity 118 can be formed by removing an inner rear portion material from rear portion 114. In many embodiments, the inner rear portion material can be removed from an opening at toe region 108. In some embodiments, the inner rear portion material can be removed from an opening in rear portion 114. In some embodiments, the inner rear portion material can be removed from an opening at sole 112 and/or an opening at heel region 106. In some embodiments, second cavity 118 can be formed by using a pull piece to prevent material from filling a part of the inner rear portion during casting to create second cavity 118. In some embodiments, approximately 8 grams (g) to approximately 30 g of material from the inner rear portion material can be removed to form second cavity 118. In some embodiments, approximately 10 g to approximately 15 g of the inner rear portion material can be removed to form second cavity 118.

Figure 5:
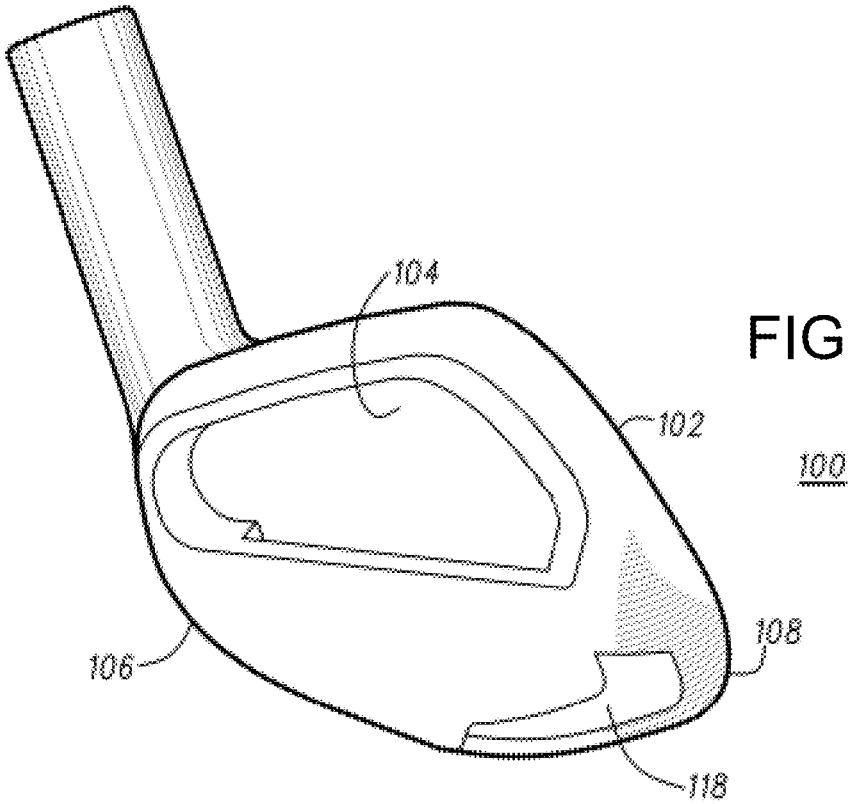
FIG. 5 depicts a back, toe-side perspective view of the golf club head of FIG. 1 according to another embodiment.

In many embodiments, mass removed and/or missing from second cavity 118 can be redistributed as perimeter weighting in golf club head 100. For example, in various embodiments, golf club head 100 can further comprise a cap 120 (FIG. 1) closing off second cavity 118. Cap 120 can provide perimeter weighting for golf club head 100. In other embodiments, such as FIG. 5, (which illustrates a back, toe-side perspective view of golf club head 100 of FIG. 1 according to an embodiment) golf club head 100 may not comprise a cap closing off second cavity 118, and second cavity 118 can be at least partially open to the environment.

In FIG. 1, cap 120 is shown at least partially at toe region 108 (such that the cap is visible from the toe-side view at address) and at least partially at sole 112 of golf club head 100 (such that the cap is visible from the sole view at address). In other embodiments, cap 120 can be located at least partially in sole 112 (such that it is visible from the sole view at address) at least partially in toe region 108 (such that it is visible from the toe-side view at address), and/or at least partially in the back of rear portion 114 (such that it is visible from the rear view at address). In some embodiments, cap 120 can close off second cavity 118 and can cover the cavity 118 opening in body 101. In embodiments wherein there is an opening in heel region 106, cap 120 can be at least partially located in heel region 106. In other embodiments when there is an opening in sole region 112, cap 120 can be at least partially located in sole region 112. In some embodiments, cap 120 can be at least partially located in rear portion 114. In embodiments wherein second cavity 118 comprises an opening in heel region 106, cap 120 in heel region 106 can be lightweight or have a cap density that is less dense than the golf club head density of body 101.

In embodiments wherein second cavity 118 comprises an opening in toe region 108, the cap density of cap 120 can be higher than a club head density of body 101. In these embodiments, the density of the cap 120 can range from 15.0 g/cc to 19.3 g/cc or from 7.5 g/cc to 8.5 g/cc.

In some embodiments, cap 120 can comprise tungsten. In some embodiments, cap 120 can comprise steel. In some embodiments, cap 120 can be welded to body 101. In other embodiments, cap 120 can be bonded and/or adhered to body 101. In some examples, cap 120 can be bonded or adhered using an adhesive, such as an expoxy.

In some embodiments, cap 120 can weigh approximately 3 g to approximately 30 g. In many embodiments, when cap 120 is at least partially located at toe region 108, cap 120 can move the center of gravity (CG) lower and toward toe region 108. In embodiments when cap 120 is at least partially located in toe region 108, cap 120 can raise the moment of inertia of body 101 and golf club head 100.

In many embodiments, cap 120 can be substantially flush with body 101. In some embodiments, cap 120 can be substantially flush with rear portion 114 such that rear portion 114 can appear substantially solid. In other embodiments, cap 120 can comprise an indication, such as a different coloring or marking, to indicate that rear portion 114 is at least partially hollow, comprises perimeter weighting, and/or is not substantially solid. In other embodiments, cap 120 can at least partially protrude from body 101. In other embodiments, cap 120 can be substantially within body 101.

Figure 9:
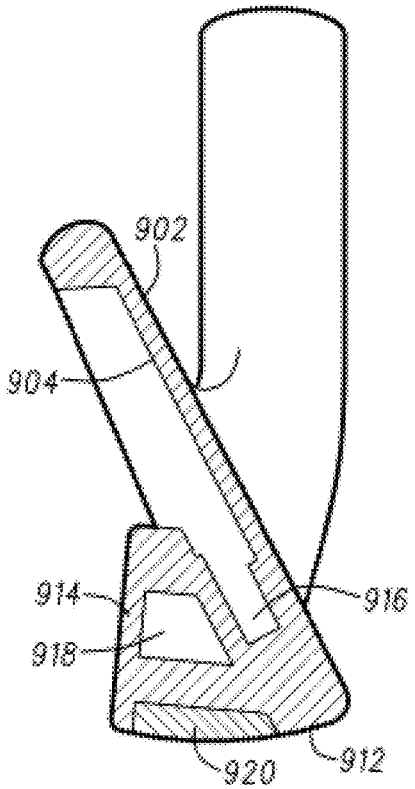
FIG. 9 depicts the golf club head of FIG. 10 along a similar cross-sectional line 9-9 in FIG. 10, according to an embodiment.
Figure 10:
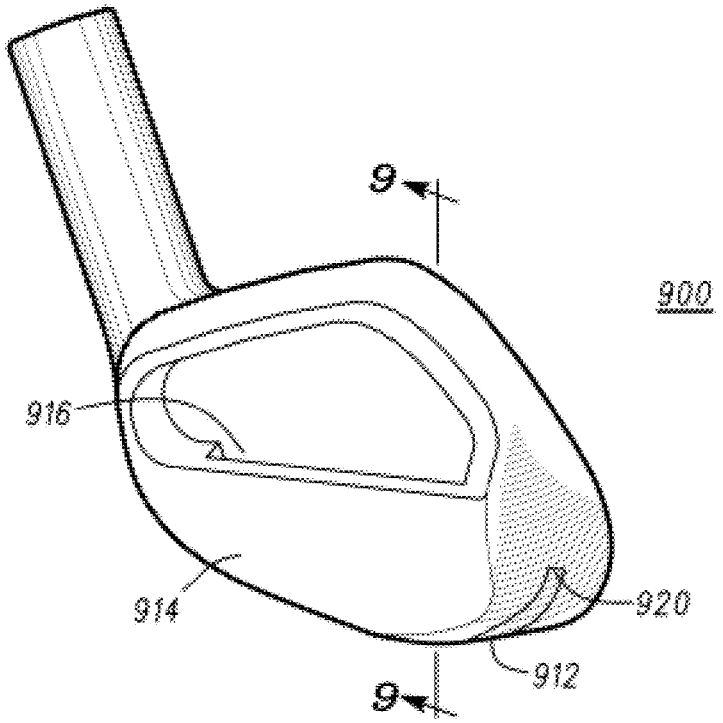
FIG. 10 depicts a back, toe-side perspective view of a golf club head, according to an embodiment.
Figure 12:
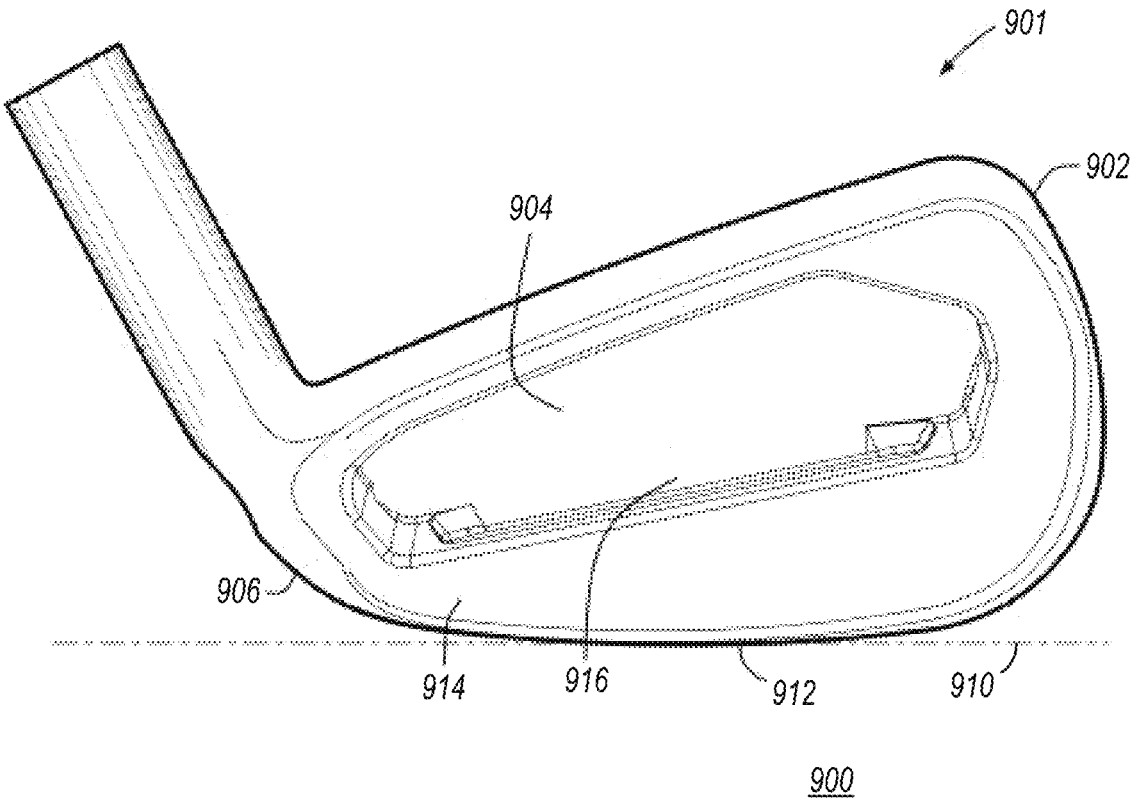
FIG. 12 depicts a rear view of the golf club head of FIG. 9.
Figure 19:
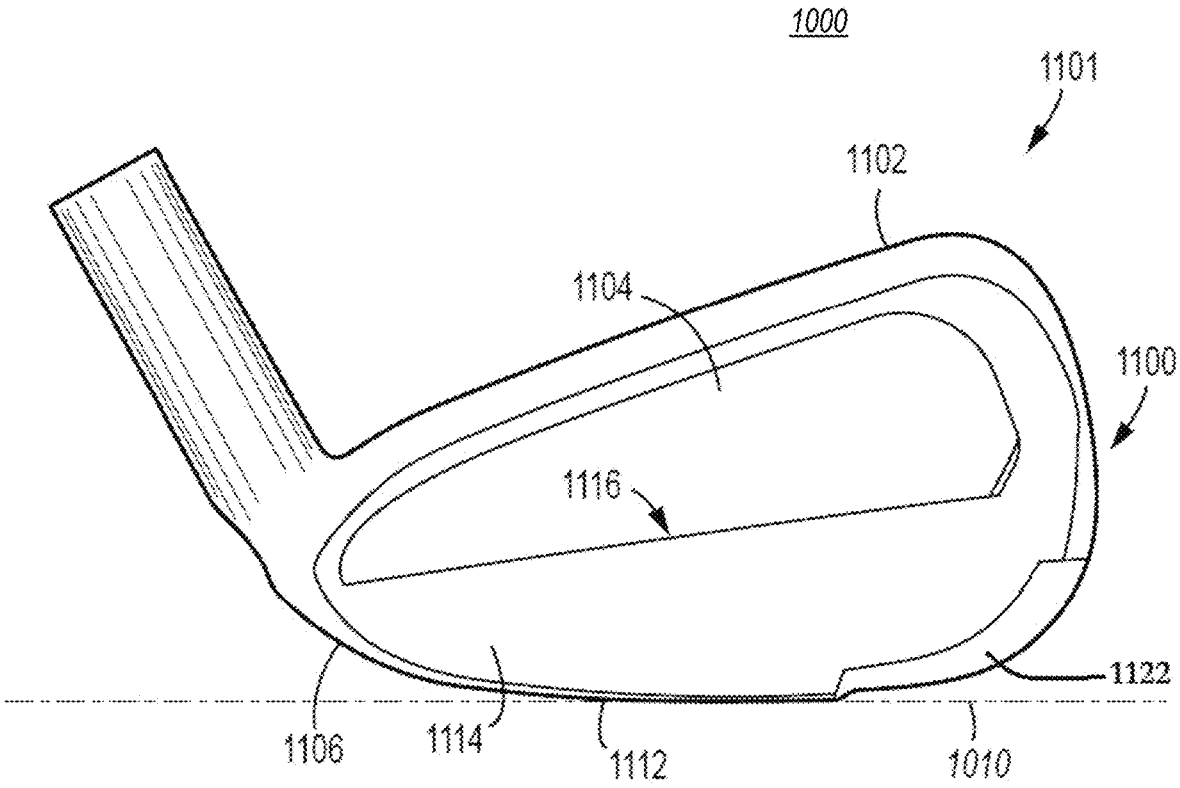
FIG. 19 depicts a rear view of a golf club head, according to an embodiment.

As shown in FIG. 1, cap 120 can be partially at toe region 108 and partially at sole 112. In some embodiments, such as cap 920 of FIG. 9 and FIG. 10, cap 920 can be at least partially within sole 112 and not visible in the rear view of portion 914. In many embodiments, cap 920 can be similar to cap 120 of FIG. 1. FIG. 9 shows a golf club head 900 along the line 9-9 of FIG. 10. FIG. 10 shows a back, toe-side perspective view of golf club head 900, according to an embodiment. In many embodiments, golf club head 900 comprises cap 920 within sole 912 and not at the back of rear portion 914. As illustrated in FIG. 12, in some embodiments of the golf club head 900, the cap 920 is not visible from the rear view. In some embodiments, such as the one depicted in FIGS. 19-24, the cap 1120 is visible from the rear view. As illustrated in FIG. 19, with the cap removed, the indention 1122 for the cap is also visible from the rear view.

In some embodiments, the second cavity 118 extends closer to the heel region 106 than the cap 120. In some embodiments, the second cavity 118 reaches a point closer to the top of the club head 100 than the cap 120.

In some embodiments, the second cavity 118 extends inward from one or more regions of the club head 100. In some embodiments, the second cavity 118 comprises an opening to the outside of the club head body. In some embodiments, the second cavity 118 opens towards the toe region 108 and does not open towards any other region of the club head 100. In other words, in these embodiments, the second cavity 118 is closed off from the outside by body geometry, such as walls 114 and 119, except where the second cavity 118 opens directly towards the toe, forming an opening visible from the toe-side view. In these embodiments, the wall 119 prevents the second cavity 118 from opening downward. Subsequently, the cap 120 intersects the wall 119 as the cap curves upward in the toe region 108.

In other embodiments, the second cavity 118 opens towards the toe region 108 and at least partially towards the sole 112. In other words, in these embodiments, the second cavity 118 is closed off from the outside by body geometry, such as walls 114 and 119, except where the second cavity 118 opens directly towards the toe and where a portion of the second cavity 118 opens downward towards the sole. When the second cavity 118 opens downwards towards the sole, the wall 119 terminates to provide the opening. In some embodiments, the second cavity 118 opens towards the toe region 108, the sole 112, and the rear portion 114.

Figure 15:
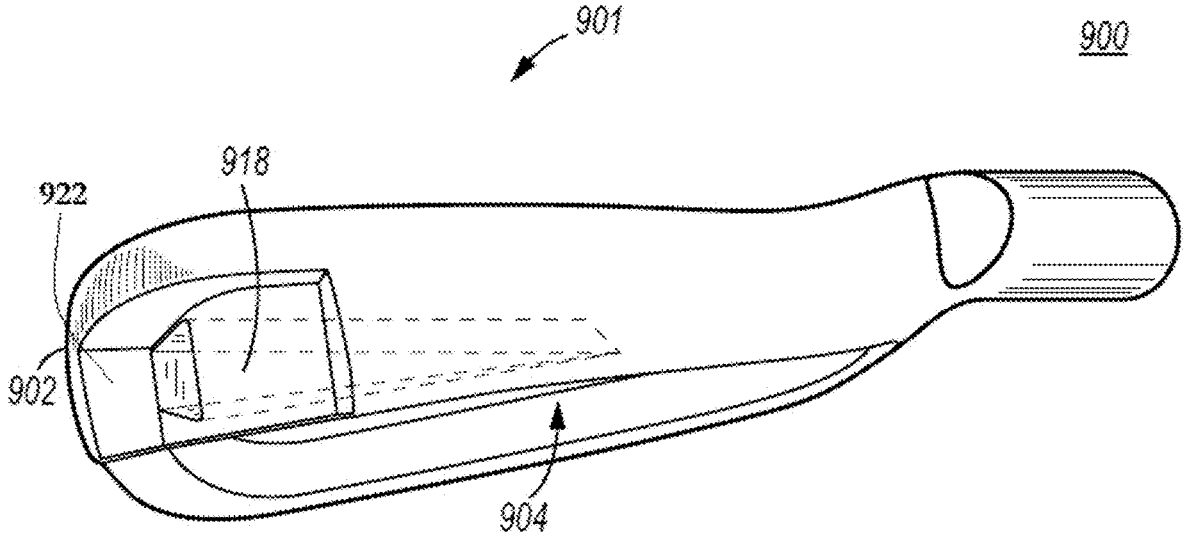
FIG. 15 depicts a sole, x-ray view of the golf club head of FIG. 9 without cap.

Considering FIGS. 1, 2, and 4, in some embodiments, with the cap 120 removed, at least half of the second cavity 118 is concealed from the sole view. In some embodiments, with the cap 120 removed, of the golf club head 100, the second cavity 118 is completely concealed from the sole view. In some embodiments, with the cap 120 removed, of the golf club head 100, the second cavity 118 is completely visible from the sole view. For example, in the embodiment of FIG. 15, the sole view shows that, with the cap 920 removed, the second cavity 918 is partially visible from the sole view and partially concealed from the sole view.

Figure 13:
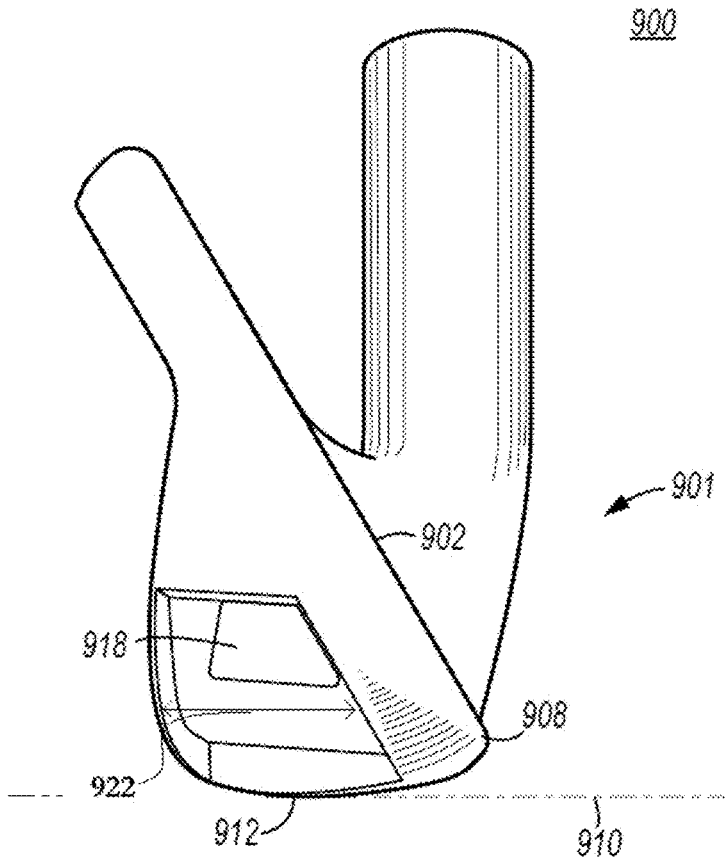
FIG. 13 depicts a toe view of the golf club head of FIG. 9 without cap.
Figure 14:
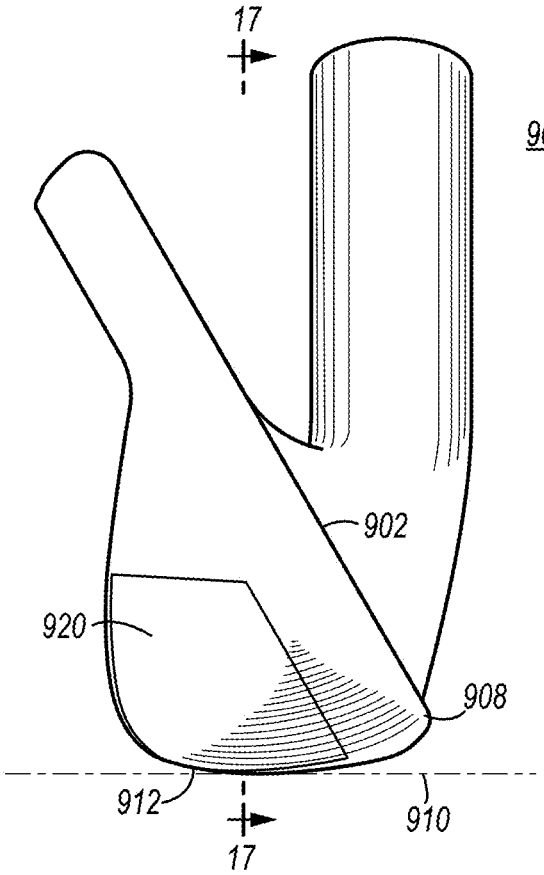
FIG. 14 depicts a toe view of the golf club head of FIG. 9 with cap.
Figure 16:
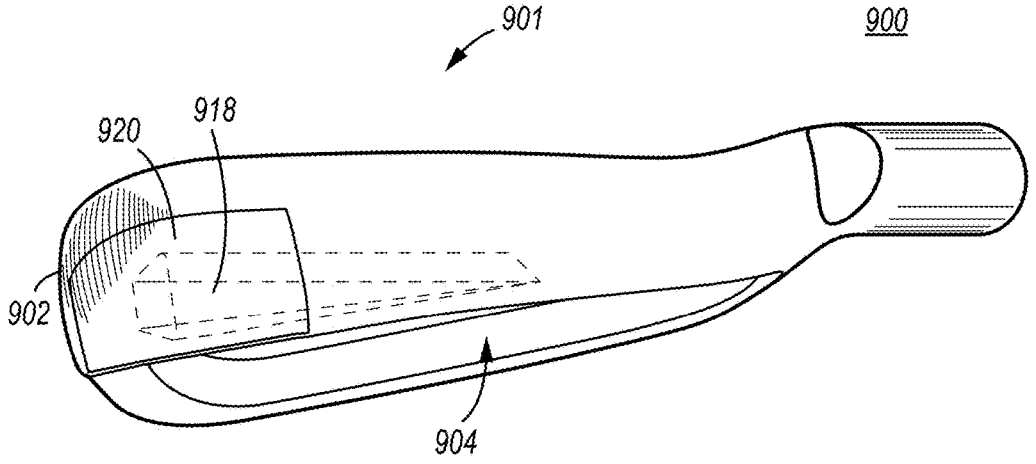
FIG. 16 depicts sole view of the golf club head of FIG. 9 with cap.

FIGS. 12-17 further illustrate the golf club head 900, similar to the golf club head 100 of FIGS. 1 and 2, which comprises a body 901 comprising a strikeface 902, a backside 904, a heel region 906, a toe region 908 opposite heel region 906, and a sole 912 at the bottom of body 901. Body 901 can further comprise a rear portion 914, a first cavity 916 between the backside 904 and the rear portion 914. Body 901 can further comprise a second cavity 918 within the rear portion 914, and a cap 920. The cap 920 can be located partially at the toe region 908 the sole 912. At least a portion of an external surface of the cap 920 is visible from a toe-side view, as shown in FIG. 14, and from a sole view, as shown in FIG. 16, of the golf club head 900 when the golf club head is at address position. The second cavity 918 extends inward from the toe region 908 in a toe-to-heel direction that is substantially parallel to the strikeface 902.

As shown in FIG. 13, the second cavity 918 contains at least a portion that is not open towards the sole, but rather is surrounded by the second cavity walls (including 914 in FIG. 9). The second cavity walls isolate at least a portion of the second cavity 918 so that at least a portion of the second cavity is not visible from the rear view or the sole view. In some embodiments, such as the embodiment of FIGS. 9-17, the golf club head 900 includes an indention 922 for the cap 920 to fit into. In this embodiment, the cap 920 is substantially flush with the body of the golf club head 900. The indention 922 that receives the cap 920 is not to be misconstrued as a portion of the second cavity. FIG. 14 depicts a toe-view of the golf club head 900 with the cap 920 installed. In some versions of this embodiment, a width of the cap as measured in a front-to-rear direction, with respect to the club head 900 at address position, may vary. The surface area of the cap that is exposed may vary.

Figure 17:
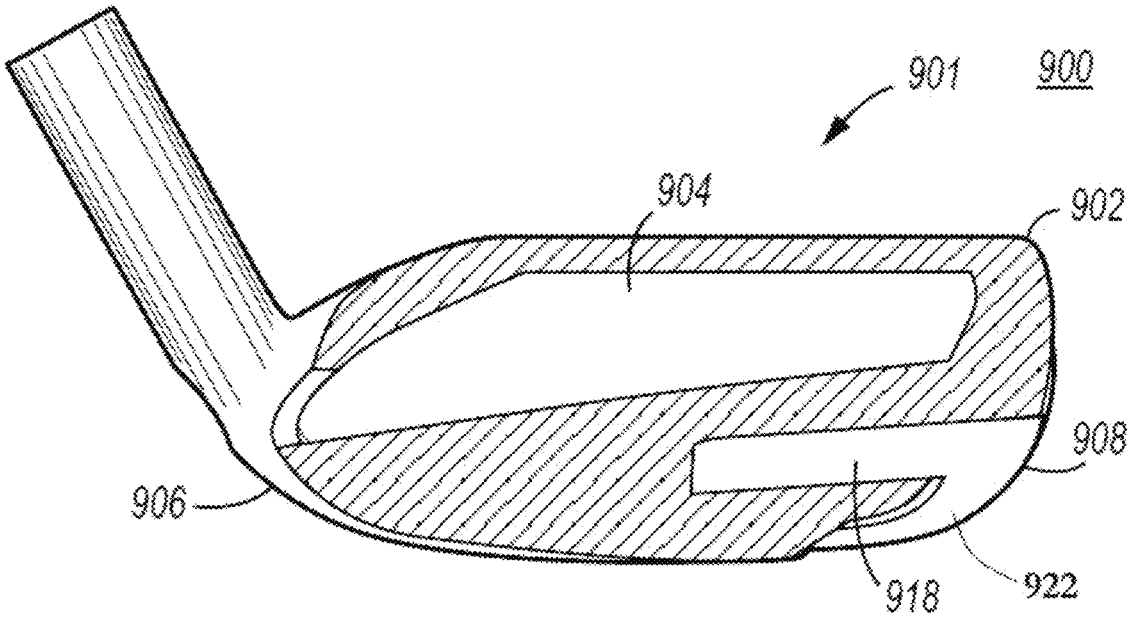
FIG. 17 depicts the golf club head of FIG. 14 along the cross-sectional line 17-17.
Figure 18:
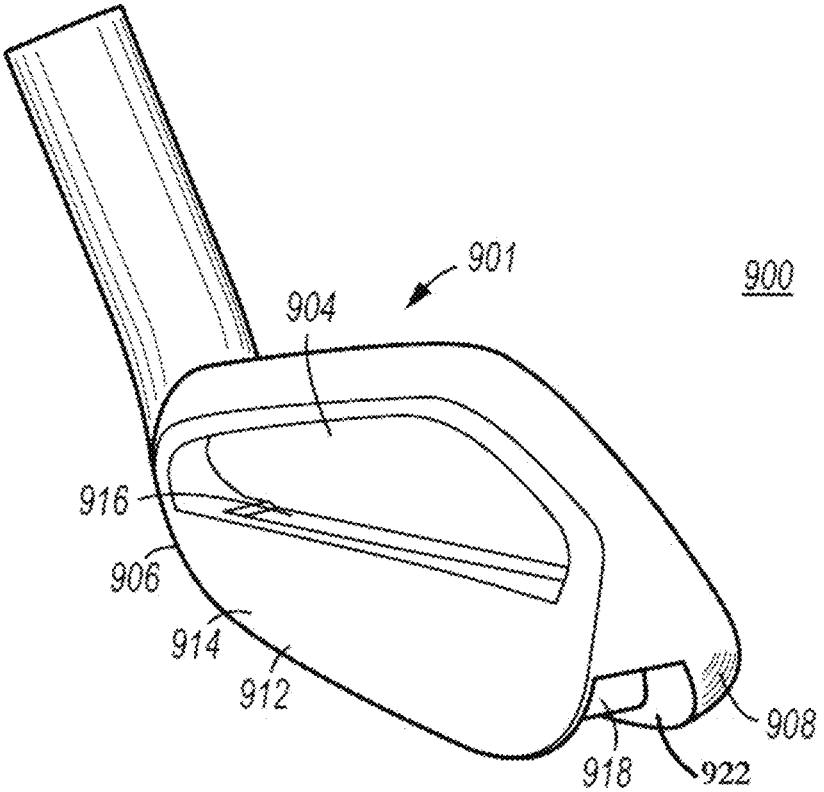
FIG. 18 depicts a back, toe-side perspective view of the golf club head of FIG. 9 without cap.

In some embodiments, the cap 920 can completely conceal the second cavity 918 and close it off from the external of the golf club head 900. FIG. 16 shows that the second cavity 918 is completely concealed from the sole view when the cap is installed, and FIG. 14 shows that the second cavity 918 is completely concealed from the toe view when the cap is installed. In some embodiments the cap 920 comprises curved contours. A cross section of the golf club head 900 along the cross-sectional line 17-17 of FIG. 14 is depicted in FIG. 17. This cross-sectional view depicts the second cavity 918 opening towards the toe region 908. Furthermore, FIG. 17 illustrates that, in the embodiment of the golf club head 900, the second cavity 918 is at least partially isolated from the sole 912. From the sole view, at least a portion of the second cavity 918 would not be visible, even with the cap 920 removed. From the rear view, at least a portion of the second cavity 918 would not be visible, even with the cap 920 removed. To further illustrate this point, FIG. 18 shows that the second cavity 918 is separated from the rear of the club head by a portion of the body 901. The golf club head 900 in FIG. 18 is pictured with the cap removed.

Figure 20:
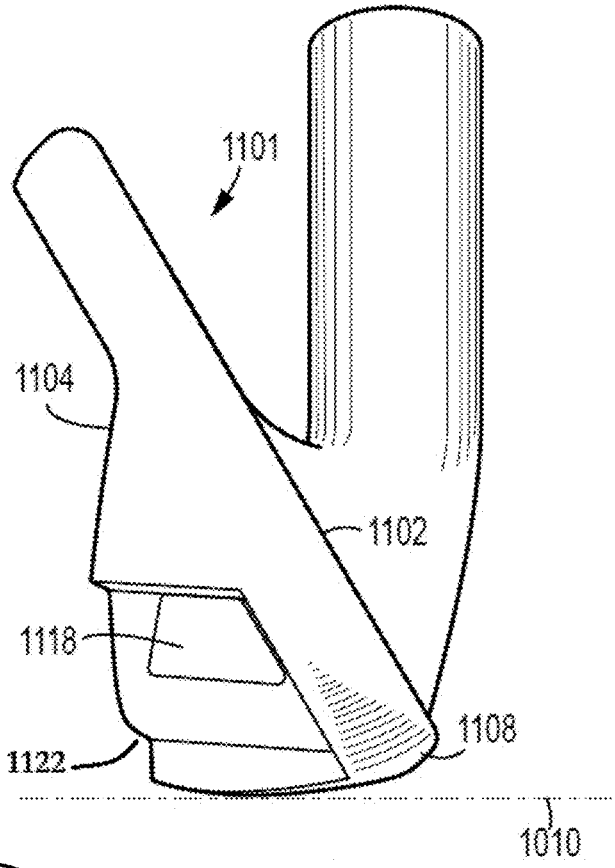
FIG. 20 depicts a toe view of the golf club head of FIG. 19 without cap.
Figure 21:
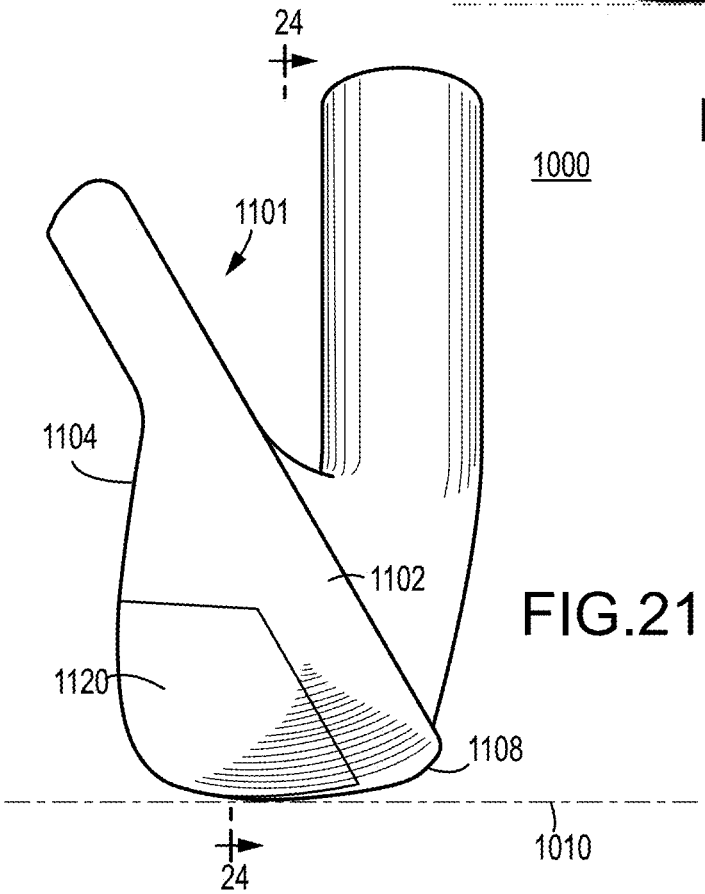
FIG. 21 depicts a toe view of the golf club head of FIG. 19 with cap.
Figure 22:
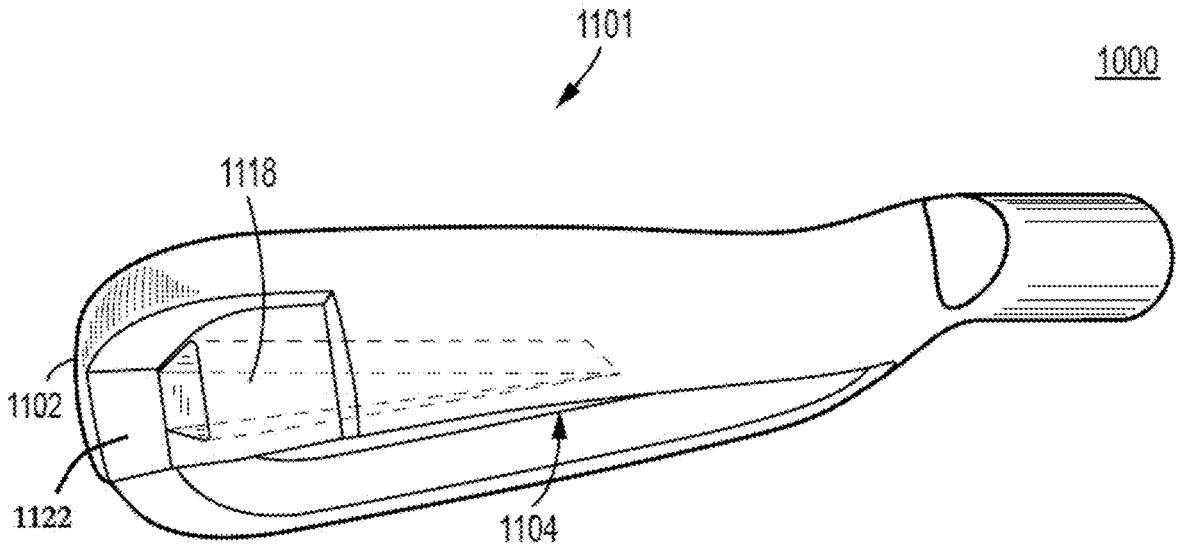
FIG. 22 depicts a sole, x-ray view of the golf club head of FIG. 1 without cap.
Figure 23:
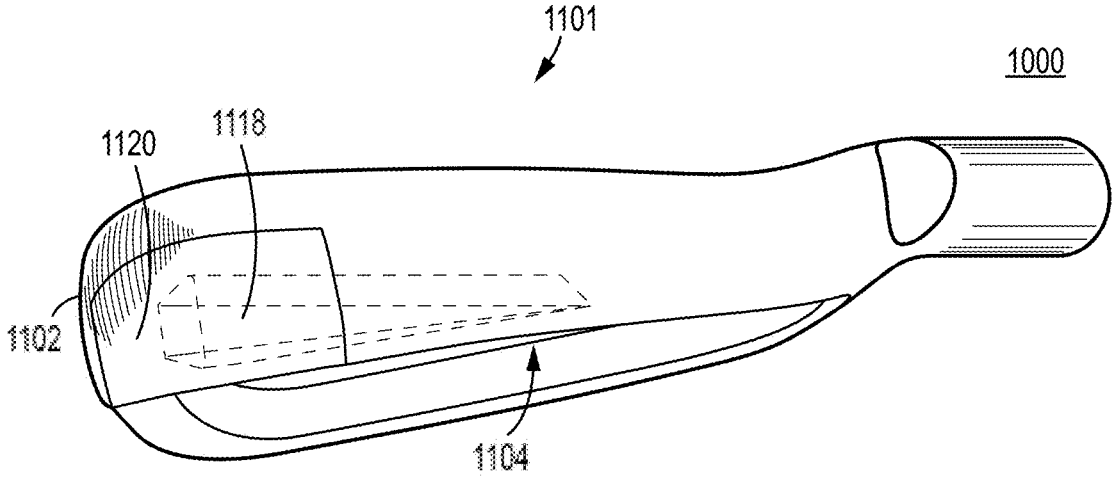
FIG. 23 depicts a sole view of the golf club head of FIG. 1 with cap.
Figure 24:
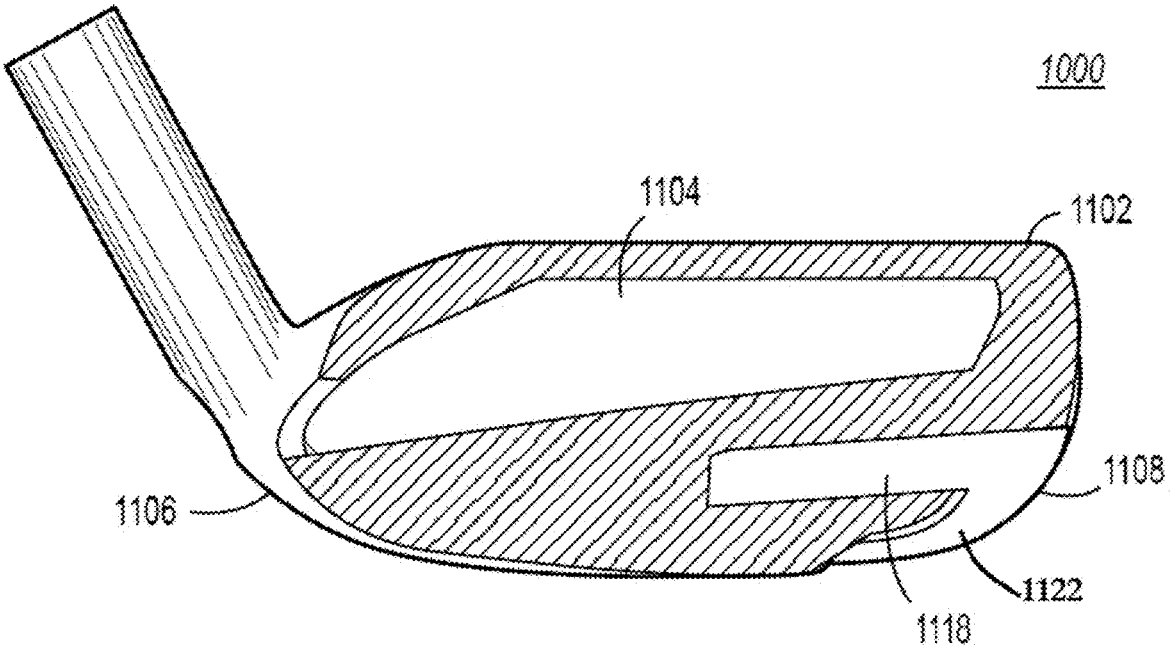
FIG. 24 depicts the golf club head of FIG. 21 along the cross-sectional line 24-24.

A golf club head 1000, which is similar to golf club head 100, is illustrated in FIGS. 19-24. This embodiment comprises a body 1101 comprising a strikeface 1102, a backside 1104, a heel region 1106, a toe region 1108 opposite heel region 1106, and a sole 1112 at the bottom of body 1101. Body 1101 can further comprise a rear portion 1114, a first cavity 1116 between the backside 1104 and the rear portion 1114. Body 1101 can further comprise a second cavity 1118 within the rear portion 1114, and a cap 1120. In this embodiment, of golf club head 1000, the cap 1120 is located at least partially in the toe region 1108, at least partially in the sole 1112, and at least partially in the rear portion 1114. As shown in FIG. 19, the indention 1122 for the cap is visible from the rear view when the club head is at address position. Although FIG. 19 depicts the club head without the cap 1120 in place, the cap 1120 is visible from the rear view when the cap 1120 is installed. As shown in FIG. 21, the cap 1120 is visible from the toe-side view when the club head is at address position. As shown in FIG. 23, the cap 1120 is visible from the sole view when the club head is at address position.

The first cavity 1116 and the second cavity 1118 of the golf club head 1000 are similar to the first cavity 116 and the second cavity 118 of the golf club head 100, described above. The second cavity 1118, located in the rear portion 1114, is closed off by the cap 1120. When the cap is removed, the second cavity 1118 is at least partially visible from the sole view, as shown in FIG. 22. When the cap is removed, the second cavity 1118 is at least partially obscured by the body 1101 from the sole view. When the cap is removed, the second cavity 1118 is at least partially visible from the toe-side view, as shown in FIG. 20. Even with the cap 1120 removed, the second cavity 1118 is obscured from the rear view in this embodiment. In some embodiments, the with the cap removed, the second cavity is at least partially visible from the rear view. In some embodiments, the second cavity is at least partially obscured from the rear view.

Returning to FIG. 1, in some embodiments, first cavity 116 can be substantially parallel to strikeface 102. In some embodiments, first cavity 116 can be forward of rear portion 114, as shown in FIG. 2. FIG. 2 illustrates golf club head 100 of FIG. 1 along the cross-sectional line 2-2 of FIG. 1. In some embodiments, second cavity 118 can be substantially parallel to strikeface 102.

Figure 7:
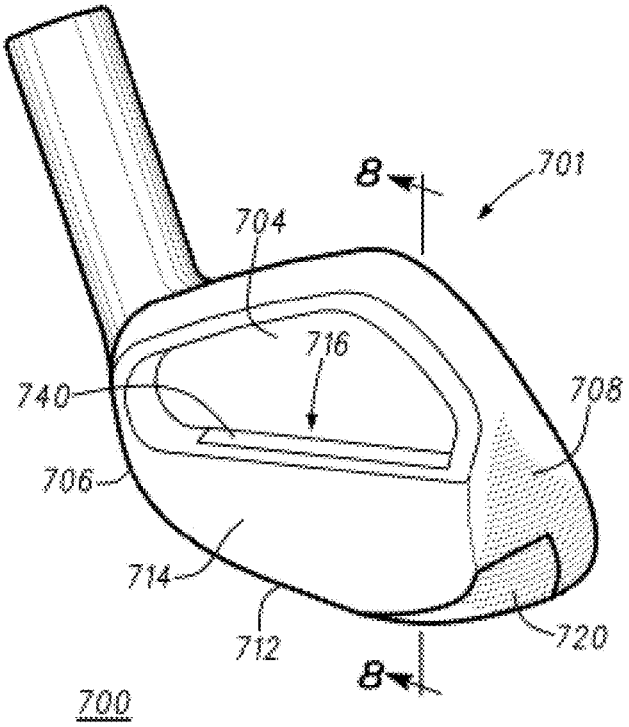
FIG. 7 depicts a back, toe-side perspective view of a golf club head according to an embodiment.
Figure 8:
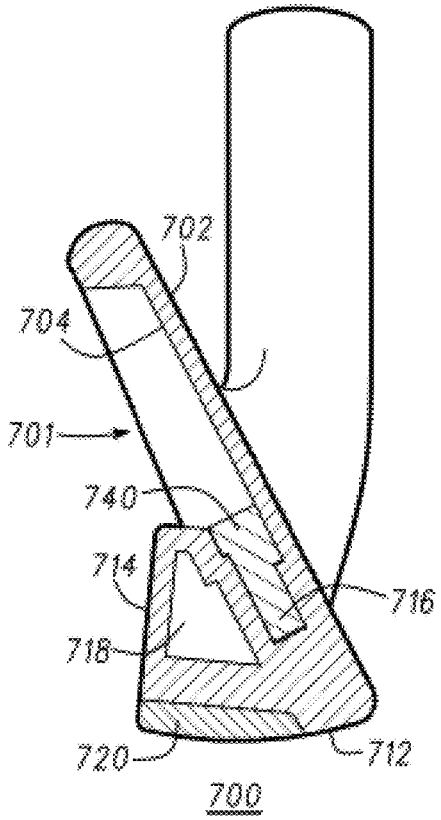
FIG. 8 depicts the golf club head of FIG. 7 along the cross-sectional line 8-8 in FIG. 7.

In some embodiments, first cavity 116 can be configured to receive an insert. For example, FIG. 8 illustrates an insert 740. FIG. 8 shows golf club head 700 along the cross-sectional line 8-8 of golf club head 700 in FIG. 7. FIG. 7 illustrates a back, toe-side perspective view of golf club head 700, according to an embodiment. As shown in FIGS. 7 and 8, Golf club head 700 comprises a body 701. In many embodiments, body 701 of FIGS. 7 and 8 can be similar to body 101 of FIG. 1. Body 701 can comprise a strikeface 702, a backside 704 of strikeface 702, a heel region 706, a toe region 708 opposite heel region 706, a sole 712, a first cavity 716 at backside 704, a rear portion 714 opposite strikeface 702, a second cavity 718 (FIG. 8), and a cap 720 closing off second cavity 718. In some embodiments, first cavity 716 can be hollow. While in many embodiments, body 701 can further comprise insert 740 (as shown in FIG. 8) at least partially within first cavity 716. In some embodiments, insert 740 can comprise a custom tuning port weight and/or a filler insert. In some embodiments, an insert material of insert 740 can be more dense than a body material of body 701. In other embodiments, the insert material of insert 740 can be the same density or less dense than the golf club head material density of body 701.

Returning to FIG. 2, rear portion 114 can have a rear portion height 127. In many embodiments and as shown in FIG. 2, rear portion height 127 can be measured from the bottom of rear portion 114 (or from a top of cap 120) to a maximum height of rear portion 114 in a direction substantially perpendicular to ground when golf club head 100 is at address. Also as shown in FIG. 2, strikeface 102 can have a strikeface height 130. Strikeface height 130 can be measured from the bottom of rear portion 114 (or from a top of cap 120) to the top of strikeface 102 in a direction substantially perpendicular to ground when golf club head 100 is at address. As measured, strikeface height 130 can be substantially parallel to rear portion height 127. In many embodiments, rear portion height 127 can be approximately one-fourth to approximately one-half of strikeface height 130. In other embodiments, rear portion height 127 can be approximately one-half to approximately three-fourths of strikeface height 130. In some embodiments, rear portion height 127 can be equal to approximately one-half of strikeface height 130.

In various embodiments, second cavity 118 can comprise a second cavity height 125. In some embodiments, second cavity height 125 can be approximately 0.20 inch (in.) to approximately 0.28 inch in height. In some embodiments, second cavity 118 can comprise a second cavity length 430 (shown in FIG. 4). In some embodiments, second cavity length 430 can be approximately 1.7 inches to 2.1 inches in length. In many embodiments, second cavity 118 can also comprise a volume of second cavity 118. In some embodiments, the volume of second cavity 118 can be approximately 0.08 $in^3$ to approximately 0.10 $in^3$.

In some embodiments, second cavity 118 can be contoured to follow the shape of rear portion 114. In many embodiments, one or more of the wall(s) of second cavity 118 can at least partially follow the shape of rear portion 114. For example, FIG. 2 shows walls 117, 119, 121, and 123 of second cavity 118 as being substantially parallel to the walls of rear portion 114. In other embodiments, second cavity 118 can only partially follow only one or more wall(s) of rear portion 114 and can have a different shape. For example, second cavity 318 (FIG. 3) can partially follow one or more wall(s) of rear portion 314 and have a trapezoid cross section shape as shown in FIG. 3.

FIG. 3 illustrates a golf club head 300 similar to the golf club head of FIG. 1 along cross-sectional line 2-2 of FIG. 1, according to another embodiment. Golf club head 300 comprises a strikeface 302, a backside 304 of the strikeface, a first cavity 316, and a sole 312. In this embodiment, second cavity walls 317 and 319 substantially follow the walls of rear portion 314, while second cavity walls 321 and 323 partially follow only one or more of the walls of rear portion 114. In other embodiments, second cavity 318 can have a substantially triangular, rectangular, square, or circular cross section. In some embodiments, the cross-sectional area of the second cavity 318, measured orthogonal to the ground plane and orthogonal to the strikeface, can change throughout rear portion 314. For example, at the toe region, the cross-sectional area of the second cavity 318 can be larger than the cross-sectional area of second cavity 318 at the heel region. In other words, the cross-sectional area of the second cavity 318 decreases as measured closer to the heel. In other examples, the cross section of second cavity 318 at the toe region can be smaller in area than the cross section of second cavity 318 at the heel region. Second cavity 318 can be covered by a cap 320.

In some embodiments, returning to FIG. 2, wall(s) 117, 119, 121, and/or 123 surrounding second cavity 118 can be substantially thin. For example, in some embodiments wall (s) 117, 119, 121, and/or 123 can be approximately 0.001 in. to approximately 0.400 in. In some embodiments, wall(s) 117, 119, 121, and/or 123 can be approximately 0.040 in. to approximately 0.150 in.

FIG. 4 illustrates another back, toe-side perspective, x-ray view of club head 100 of FIG. 1. In FIG. 4, second cavity 118 is shown as dashed lines within rear portion 114. In some embodiments, second cavity 118 can extend from heel region 106 to toe region 108. In other embodiments, second cavity can extend from the middle of rear portion 114 to toe region 108. In some embodiments, second cavity can extend from the middle of rear portion 114 to heel region 106. In other embodiments, second cavity can be located only at toe region 108. Second cavity 118 can be substantially parallel to strikeface 102. In other embodiments, only one wall of second cavity 118 can be substantially parallel to strikeface 102. In some embodiments, second cavity 118 is not substantially parallel to strikeface 102. In many embodiments, second cavity 118 can be substantially hollow and/or empty. In other embodiments, second cavity 118 can comprise a weight or other filler material.

Figure 6:
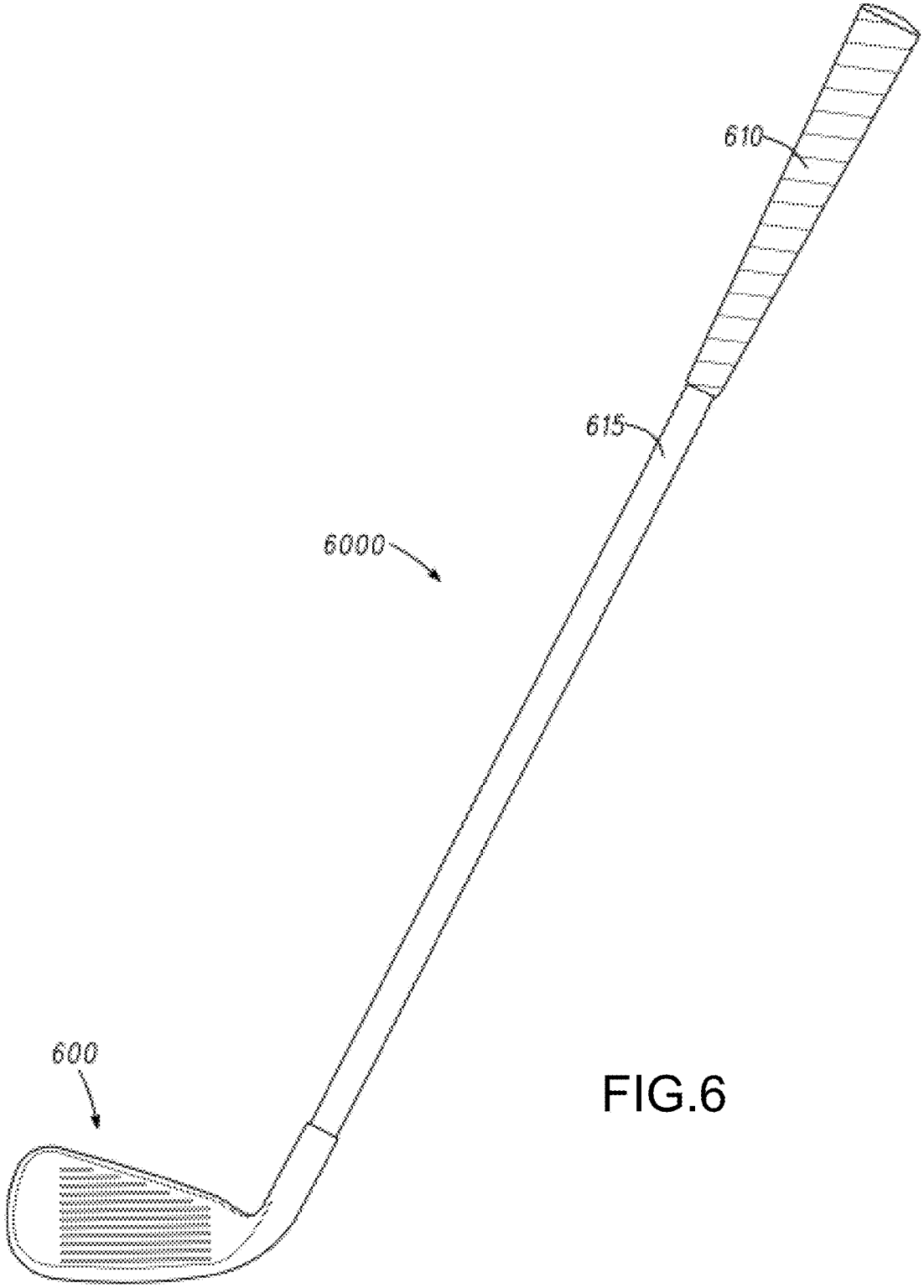
FIG. 6. depicts a front view of a golf club according to an embodiment.

Some embodiments include a fully assembled golf club, such as a golf club 6000 as shown in FIG. 6. FIG. 6 shows a front view of a golf club 6000 according to an embodiment. In some embodiments, golf club 6000 can comprise a shaft 615, a grip 610 at one end of shaft 615, and a golf club head 600 coupled to shaft 615 at an opposite end of shaft 615. In many embodiments, golf club head 600 can be similar to golf club head 100 (FIG. 1), golf club head 300 (FIG. 3), golf club head 700 (FIG. 7), and/or golf club head 900 (FIG. 10). In some embodiments, golf club 6000 is an iron-type golf club. In other embodiments, golf club 6000 can be another type of golf club head (e.g., a driver-type club head, a fairway wood-type club head, a hybrid-type club head, a wood-type club head, a wedge-type club head, or a putter-type club head.).

Figure 11:
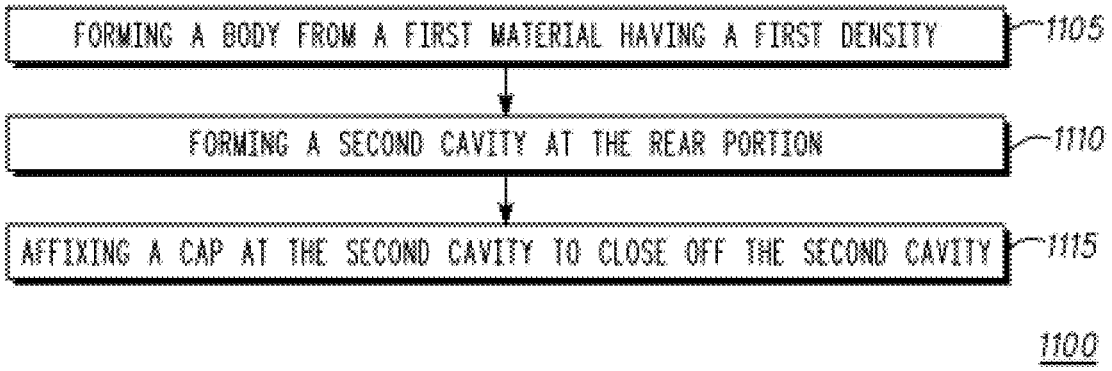
FIG. 11 depicts a method of manufacturing a golf club head according to an embodiment of a method.

Various embodiments include a method 1100 for manufacturing a golf club head as shown in FIG. 11. FIG. 11 depicts a method of manufacturing a golf club head according to an embodiment. In some embodiments, method 1100 can be used to manufacture a golf club head similar to golf club head 100 (FIG. 1), golf club head 300 (FIG. 3), golf club head 600 (FIG. 6), golf club head 700 (FIG. 7), golf club head 900 (FIG. 10), and/or golf club head 1000 (FIG. 19).

In many embodiments, method 1100 comprises forming a body from a first material having a first density (block 1105). In some embodiments, forming a body from a first material can comprise forging the body. In other embodiments, forming a body from a first material can comprise casting the body. In some embodiments, method 1100 can comprise manufacturing a golf club head for an iron-type club head. In many embodiments, method 1100 can comprise forming a strikeface, a backside of the strike face, a heel region, a toe region opposite the heel region, a sole, and a first cavity at the backside of the strikeface for the body formed in block 1105.

In many embodiments, method 1100 can further comprise forming a rear portion opposite the strikeface in the body formed in block 1105. In many embodiments, and similar to as described above and shown in FIG. 2, the rear portion can have a rear portion height. In many embodiments, the rear portion height can be measured from the bottom of the rear portion to a maximum height of the rear portion. Additionally, as shown in FIG. 2, strikeface 102 can comprise a strikeface height which can be measured from the bottom of rear portion 114 to the top of strikeface. As shown in FIG. 2, as measured, strikeface height 130 can be substantially parallel to rear portion height 127.

In many embodiments, forming the second cavity in block 1110 of method 1100 can comprise forming the rear portion height to be approximately one-fourth to approximately one-half of the strikeface height. In other embodiments, forming the second cavity in block 1110 can comprise forming the rear portion height to be approximately one-half to approximately three-fourths of the strikeface height. In some embodiments, forming the second cavity in block 1110 of method 1100 can comprise forming the rear portion height to be equal to approximately one-half of the strikeface height.

In some embodiments, method 1100 can comprise configuring the first cavity to receive an insert, while in other embodiments first cavity can be configured to be hollow and/or to not receive an insert. For example, method 1100 can comprise forming body 701, as shown in FIG. 7, and configuring first cavity 716 to receive insert 740. In some embodiments, an insert material of insert 740 can be more dense than a body material of body 701. In other embodiments, the insert material of insert 740 can be the same density or less dense than the body material of body 701. In some embodiments, a length of the first cavity can be substantially parallel to the strikeface, as shown by first cavity 116 of FIG. 1. In some embodiments, the first cavity can be forward of the rear portion, such as shown in golf club head 100 of FIG. 2.

In many embodiments, method 1100 can also comprise forming a second cavity at the rear portion (block 1110) and affixing a cap at the second cavity to close off the second cavity (block 1115). In some embodiments, block 1110 of forming the second cavity at the rear portion can further comprise removing an inner rear portion material from the rear portion. In many embodiments, the inner rear portion can be removed from an opening in the toe region. In some embodiments, the inner rear portion can be removed from an opening in the sole and/or an opening in the heel. Drilling, cutting, chiseling, grinding, or other methods of milling can be used to remove material from the inner rear portion to form the second cavity. In some embodiments, the second cavity at the rear portion formed in block 1110 can be formed by using a pull piece to create the second cavity. The pull piece prevents material from filling the second cavity during a casting process, and the pull piece is removed after casting. In some embodiments, block 1110 comprises removing approximately 8 g to approximately 30 g of material from the rear portion. In some embodiments, block 1110 comprises removing approximately 10 g to approximately 15 g from the rear portion.

Forming the second cavity in block 1110 can further comprise extending the second cavity from the heel region to the toe region. For example, as shown in FIG. 4, second cavity 118 can be formed to extend from heel region 106 to toe region 108. In other embodiments, forming the second cavity can comprise extending the second cavity from the middle of the rear portion to the toe region. In some embodiments, forming the second cavity can comprise extending the second cavity from the middle of the rear portion to the heel region. In other embodiments, forming the second cavity can comprise forming second cavity at the toe region. In some embodiments, block 1110 of method 1100 can further comprise forming the second cavity to be substantially parallel to the strikeface. For example, as shown in FIG. 4, second cavity 118 can be substantially parallel to strikeface 102. In other embodiments, block 1110 can comprise forming the second cavity wherein only one wall of the second cavity can be substantially parallel to the strikeface. In some embodiments, the second cavity is not formed to be substantially parallel to the strikeface. In many embodiments, block 1110 of method 1100 can comprise forming the second cavity to be hollow and/or empty. In other embodiments, block 1110 method 1100 can comprise forming the second cavity so that the second cavity can comprise a weight and/or other filler material.

In some embodiments, forming the second cavity in block 1110 of method 1100 can comprise forming the second cavity to have a second cavity height. In various embodiments, forming the second cavity in block 1110 can comprise forming the second cavity height to be approximately 0.20 inch to approximately 0.28 inch in height.

In some embodiments, forming the second cavity in block 1110 of method 1100 can comprise forming a second cavity length, such as second cavity length 430 as shown in FIG. 4, to be approximately 1.7 inch to approximately 2.1 inch in length. In many embodiments, forming the second cavity in block 1110 of method 1100 can comprise forming the second cavity to have a second cavity volume of approximately 0.08 $in^3$ to approximately 0.10 $in^3$. In some embodiments, forming the second cavity in block 1110 can comprise removing approximately 3 g to approximately 30 g from the rear portion. In other embodiments, forming the second cavity in block 110 can comprise removing approximately 3 g to approximately 11 g from the rear portion. In some embodiments, forming the second cavity in block 1110 comprises forming the second cavity to be hollow.

In many embodiments, forming the second cavity in block 1110 comprises forming the second cavity only at the rear portion. For example, second cavity 118 of FIG. 2 can be formed at rear portion 114. In many embodiments, forming the second cavity in block 1110 of method 1100 can comprise contouring the second cavity to follow the shape of the rear portion, such as, in some examples, second cavity 118 of FIG. 2. In other embodiments, forming the second cavity in block 1110 can comprise forming the second cavity to comprise a different cross-sectional shape, such as a trapezoidal shape as shown in second cavity 318 of FIG. 3.

In other embodiments, forming the second cavity in block 1110 can comprise forming the second cavity to comprise a substantially triangular, rectangular, square, or circular cross-section in at least a portion of the second cavity. In some embodiments, the cross-section of the second cavity can change throughout the rear portion. In other embodiments, the cross-section of the second cavity can remain the same throughout the rear portion of the golf club head. For example, the second cavity formed in block 1110 can have a cross-sectional area at the heel region larger than the cross section of the second cavity at the toe region. In other examples, the cross-sectional area of second cavity formed in block 1110 at the heel region can be smaller than the cross-sectional area at the toe region.

In some embodiments, the one or more of the walls surrounding the second cavity (such as wall(s) 117, 119, 121, and/or 123 in FIG. 2) can be formed to be substantially thin. For example, in some embodiments, wall(s) 117, 119, 121, and/or 123 of FIG. 2, can be formed to be approximately 0.001 in. to approximately 0.400 in. in thickness. In some embodiments, wall(s) 117, 119, 121, and/or 123 can be formed to be approximately 0.040 in to approximately 0.150 in. in thickness.

In some embodiments, method 1100 can further comprise affixing a cap at the second cavity to close off the second cavity (block 1115). The cap can be affixed to the club head by the application of an adhesive, a welding process, a mechanical fastening mechanism, or any other suitable method of bonding. In many embodiments, affixing the cap at the second cavity comprises affixing the cap at least partially at the toe region of the golf club head. For example, FIG. 1 shows cap 120 affixed at least partially at toe region 108 of golf club head 100. In other embodiments, affixing the cap at the second region can comprise affixing the cap at least partially at the sole of the golf club head, at least partially at the toe region, and/or at least partially at the heel region of the golf club head. For example, FIG. 16 depicts one embodiment of the cap 920 affixed at least partially at the sole, and FIG. 14 depicts the same embodiment of the cap 920 affixed at least partially at the toe region. In some embodiments, affixing the cap at the second region can comprise affixing the cap at least partially at the rear portion. For example, FIG. 23 depicts one embodiment of the cap 1120 affixed at least partially at the sole, and FIG. 19 depicts the same embodiment of the cap 1120 affixed at least partially at the rear portion. In some embodiments, the cap can weigh approximately 3 g to approximately 30 g. In some embodiments, the cap can weigh approximately 3 g to approximately 25 g.

In many embodiments, the cap comprises a cap density of the cap that is higher that a club head density of the body. In other embodiments, the cap comprises a cap density of the cap that is the same or lower than the club head density of the body. However the cap of the preferred embodiment has a higher density so that the cap contributes to the perimeter weighting of the club head. Perimeter weighting increases MOI, which makes the club head more forgiving and improves performance. The second cavity of the club head reduces the overall weight of the head, thus allowing weight to be concentrated at the toe and sole perimeter region to provide forgiveness without modifying the overall muscleback iron appearance.

In some embodiments, the cap can comprise tungsten. In some embodiments, the cap can comprise steel. In many embodiments, cap 120 can be affixed so that it is substantially flush with the body of the golf club head. For example, as shown in FIG. 1, cap 120 is substantially flush with body 101 of golf club head 100. In other embodiments, the cap can at least partially protrude from the body.

The golf club heads with cavities and related methods discussed herein may be implemented in a variety of embodiments, and the foregoing discussion of these embodiments does not necessarily represent a complete description of all possible embodiments. Rather, the detailed description of the drawings, and the drawings themselves, disclose at least one preferred embodiment of systems and methods for fitting golf club head weight, and may disclose alternative embodiments of golf club heads with cavities and related methods.

All elements claimed in any particular claim are essential to golf club heads with cavities and related methods claimed in that particular claim. Consequently, replacement of one or more claimed elements constitutes reconstruction and not repair. Additionally, benefits, other advantages, and solutions to problems have been described with regard to specific embodiments. The benefits, advantages, solutions to problems, and any element or elements that may cause any benefit, advantage, or solution to occur or become more pronounced, however, are not to be construed as critical, required, or essential features or elements of any or all of the claims.

As the rules to golf may change from time to time (e.g., new regulations may be adopted or old rules may be eliminated or modified by golf standard organizations and/or governing bodies such as the United States Golf Association (USGA), the Royal and Ancient Golf Club of St. Andrews (R&A), etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Moreover, embodiments and limitations disclosed herein are not dedicated to the public under the doctrine of dedication if the embodiments and/or limitations: (1) are not expressly claimed in the claims; and (2) are or are potentially equivalents of express elements and/or limitations in the claims under the doctrine of equivalents.

What is claimed is:

1. A golf club head comprising:
a body comprising:
a strikeface;
a backside of the strikeface;
a heel region;
a toe region opposite the heel region;
a sole, wherein
a first cavity at the backside of the strikeface;
wherein the first cavity is between the backside of the strikeface and a rear portion opposite the strikeface;
and
a second cavity within the rear portion, wherein
the second cavity extends inward from the toe region in a toe-to-heel direction that is substantially parallel to the strikeface;
wherein the second cavity contains at least a portion that is not open towards the sole but is surrounded by second cavity walls such that the second cavity walls isolate at least a portion of the second cavity so that at least a portion of the second cavity is not visible from a rear view or a sole view;
wherein the second cavity is not open toward the heel region;
an indention wherein the indention is not a part of the second cavity;
a cap closing off the second cavity; wherein
the cap is located at least partially in the sole and partially in the toe region;
wherein the cap is installed when received in the indention; and
wherein the second cavity is completely concealed from the toe-side view and the sole view when the cap is installed in the indention;
at least a portion of an external surface of the cap is visible from a toe-side view and the sole view of the golf club head, wherein
the toe-side view displays the club head from a toe-to-heel direction that is parallel to the strikeface and parallel to the ground plane when the club head is at address position, and
the sole view displays the club head from a sole-to-top direction orthogonal to the ground plane when the club head is at address position;

wherein at least a portion of the second cavity remains hollow when the cap closes off the second cavity.

2. The golf club head of claim 1, wherein:

the first cavity is configured to receive an insert.

3. The golf club head of claim 1, wherein:

a length of the first cavity is substantially parallel to the strikeface and forward of the rear portion.

4. The golf club head of claim 1, wherein:

the cap weighs approximately 3 g to approximately 25 g.

5. The golf club head of claim 1, wherein:

the cap comprises a cap material comprising tungsten.

6. The golf club head of claim 1, wherein:

the golf club head is an iron-type club head; and at least a portion of the first cavity is located between the strikeface and the second cavity.

7. The golf club head of claim 1, wherein:

a cross-sectional area of the second cavity, measured orthogonal to the ground plane and orthogonal to the strikeface, decreases as measured closer to the heel region.

8. The golf club head of claim 1, wherein:

the cap comprises a density higher than a body density of the body.

9. A golf club comprising:

a shaft;

a grip; and a golf club head comprising:

a body comprising:

a strikeface;

a backside of the strikeface;

a heel region;

a toe region opposite the heel region;

a sole, wherein a first cavity at the backside of the strikeface;

a rear portion opposite the strikeface;

wherein the first cavity is between the backside of the strikeface and the rear portion;

and a second cavity within the rear portion, wherein the second cavity extends inward from the toe region in a toe-to-heel direction that is substantially parallel to the strikeface;

wherein the second cavity contains at least a portion that is not open towards the sole but is surrounded by second cavity walls such that the second cavity walls isolate at least a portion of the second cavity so that at least a portion of the second cavity is not visible from a rear view or a sole view;

wherein the second cavity is not open toward the heel region;

an indention wherein the indention is not a part of the second cavity;

a cap closing off the second cavity; wherein the cap is located at least partially in the sole and partially in the toe region; and wherein the cap is installed when received in the indention; and wherein the second cavity is completely concealed from the toe-side view and the sole view when the cap is installed in the indention;

at least a portion of an external surface of the cap is visible from a toe-side view and a sole view of the golf club head when the golf club head is at address position;

wherein at least a portion of the second cavity remains hollow when the cap closes off the second cavity.

10. The golf club of claim 9, wherein:

the first cavity is configured to receive an insert.

11. The golf club of claim 9, wherein:

a length of the first cavity is substantially parallel to the strikeface and forward of the rear portion.

12. The golf club of claim 9, wherein:

the cap weighs approximately 3 g to approximately 25 g.

13. The golf club of claim 9, wherein:

the cap comprises a cap material comprising tungsten.

14. The golf club of claim 9, wherein:

the golf club head is an iron-type club head; and at least a portion of the first cavity is located between the strikeface and the second cavity.

15. The golf club of claim 9, wherein:

a cross-sectional area of the second cavity, measured orthogonal to the ground plane and orthogonal to the strikeface, decreases as measured closer to the heel region.

16. The golf club of claim 9, wherein:

the cap comprises a density higher than a body density of the body.

* * * * *